US007056880B2

(12) United States Patent
Wang et al.

(10) Patent No.: US 7,056,880 B2
(45) Date of Patent: Jun. 6, 2006

(54) USING CATIONIC CELLULOSES TO ENHANCE DELIVERY OF FABRIC CARE BENEFIT AGENTS

(75) Inventors: Jiping Wang, West Chester, OH (US); Rajan Keshav Panandiker, West Chester, OH (US); Paul Francis Kindel, Reading, OH (US); Mary Ruth Leyendecker, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 109 days.

(21) Appl. No.: 10/658,146

(22) Filed: Sep. 9, 2003

(65) Prior Publication Data

US 2004/0121930 A1 Jun. 24, 2004

Related U.S. Application Data

(63) Continuation-in-part of application No. 10/375,792, filed on Feb. 26, 2003, now Pat. No. 6,897,190.

(60) Provisional application No. 60/409,091, filed on Sep. 9, 2002, provisional application No. 60/360,342, filed on Feb. 28, 2002.

(51) Int. Cl.
*C11D 3/22* (2006.01)
*C11D 3/37* (2006.01)

(52) U.S. Cl. ..... 510/515; 510/276; 510/287; 510/300; 510/305; 510/306; 510/308; 510/466; 510/471; 510/473; 510/475

(58) Field of Classification Search ..... 510/515, 510/276, 287, 300, 305, 306, 308, 466, 471, 510/473, 475

See application file for complete search history.

(56) References Cited

U.S. PATENT DOCUMENTS

| | | | | |
|---|---|---|---|---|
| 3,580,853 | A | 5/1971 | Parran, Jr. | |
| 4,237,016 | A | 12/1980 | Rudkin et al. | |
| 4,969,925 | A * | 11/1990 | Sisco et al. | 510/151 |
| 5,476,660 | A * | 12/1995 | Somasundaran et al. | 424/401 |
| 5,534,265 | A * | 7/1996 | Fowler et al. | 424/489 |
| 5,919,440 | A * | 7/1999 | Kaiser et al. | 424/76.4 |
| 5,932,203 | A * | 8/1999 | Coffindaffer et al. | 424/70.19 |
| 5,939,085 | A * | 8/1999 | Jacobs et al. | 424/401 |
| 6,040,282 | A * | 3/2000 | Guskey et al. | 510/119 |
| 6,200,554 | B1 * | 3/2001 | Yeoh et al. | 424/70.12 |
| 6,268,431 | B1 * | 7/2001 | Snyder et al. | 524/555 |
| 6,335,312 | B1 * | 1/2002 | Coffindaffer et al. | 510/159 |
| 6,440,911 | B1 * | 8/2002 | Bettiol et al. | 510/137 |
| 6,827,795 | B1 * | 12/2004 | Kasturi et al. | 134/42 |

FOREIGN PATENT DOCUMENTS

| | | |
|---|---|---|
| DE | 1999 26 863 | 12/2000 |
| WO | WO 94/03152 | 2/1994 |
| WO | WO 00/59463 | 10/2000 |

* cited by examiner

*Primary Examiner*—Charles Boyer
(74) *Attorney, Agent, or Firm*—Armina E. Matthews; Brahm J. Corstanje; Kim William Zerby

(57) ABSTRACT

Laundry product compositions containing a stable mixture of at least one water insoluble fabric care benefit agent and at least one delivery enhancing agent that is preferably a dispersible polyolefin, polymer latex, or mixture thereof. Detergent laundry product compositions containing from about 1% to about 80%, by weight of the composition, of a detersive surfactant that is an anionic surfactant, cationic surfactant, nonionic surfactant, amphoteric surfactant, zwitterionic surfactant, or a mixture thereof; from about 0.1% to about 10%, by weight of the composition, of a water insoluble fabric care benefit agent; from about 0.01% to about 5%, by weight of the composition, of a delivery enhancing agent; and wherein the ratio of the delivery enhancing agent to the fabric care benefit agent is from about 1:50 to about 1:1.

16 Claims, No Drawings

USING CATIONIC CELLULOSES TO ENHANCE DELIVERY OF FABRIC CARE BENEFIT AGENTS

CROSS REFERENCE TO RELATED APPLICATIONS

This application claims the benefit of priority to U.S. Provisional Application Ser. No. 60/409,091, filed Sep. 9, 2002, and is a continuation-in-part of U.S. Application Ser. No. 10/375,792, filed Feb. 26, 2003, now U.S. Pat. No. 6,897,190 which claims priority to U.S. Provisional Application Ser. No. 60/360,342, filed Feb. 28, 2002, all of which are herein incorporated by reference.

FIELD OF THE INVENTION

The present invention relates to the use of cationic celluloses to enhance deposition of water insoluble fabric care benefit agents such as dispersible polyolefins and latexes during laundering.

BACKGROUND OF THE INVENTION

Laundering textiles is a necessity in order to remove stains, odors and soils. However, during the laundering process, textiles can undergo mechanical and chemical damage which can result in fabric wrinkles, color fading, dye transfer, pills/fuzz, fabric wear, fiber deterioration, stiffness, and other undesirable consumer issues. Therefore, many laundry products such as detergents, fabric conditioners, and other wash, rinse, and dryer added products, frequently include one or more fabric care benefit agents that are added in an attempt to reduce or prevent these consumer issues.

However, such fabric care benefit agents often provide limited benefits due to poor delivery efficiency on the fabrics or textiles during the laundering process. The affinity between these fabric care agents and fabrics/garments is typically very limited due to the lack of natural attractive forces between the fabric care agents and the fabrics. This is because most fabric care agents used in laundry products are formulated to be anionic or nonionic in order to avoid interaction with anionic surfactants which might lead to potential cleaning negatives. Since most textile fibers such as cotton, wool, silk, nylon, and the like carry a slightly anionic charge in the laundry solution, there are repulsive instead of attractive forces between the fabric care agent and the fabric resulting in poor delivery efficiency.

This is particularly true of water insoluble fabric care benefit agents, examples of which include but are not limited to, dispersible polyolefins, polymer latexes and the like. Due to their water insolubility, water insoluble fabric care benefit agents are generally incorporated into laundry product formulations in some type of water stable form such as an emulsion, a latex, a dispersion, a suspension, or the like. When added to the laundry product in a water stable form, the water insoluble fabric care benefit agent becomes even more stable in solution. This is due to the existence of large amounts of surfactant that are present in laundry products. The surfactant in the laundry products tends to act as an emulsifying agent, dispersion agent, suspension agent, or the like thereby resulting in the further stabilization of the emulsion, dispersion, and/or suspension containing the water insoluble fabric care benefit agent. As a result of this stabilization, the affinity of the water insoluble fabric care benefit agent for the fabric is severely limited. The majority of the water insoluble fabric care benefit agent tends to stay in solution wherein it is discarded with the wash solution thereby limiting the amount of benefit agent available for deposition on the fabric.

Accordingly, there is a need to improve the fabric delivery efficiency of water insoluble fabric care benefit agents that are incorporated into laundry products.

SUMMARY OF THE INVENTION

The laundry products of the present invention comprise at least one water insoluble fabric care benefit agent and at least one cationic cellulose delivery enhancing agent or deposition aid.

Without being limited by theory, it is believed that the laundry products of the present invention improve the fabric delivery efficiency of water insoluble fabric care benefit agents that are incorporated therein by the inclusion of the cationic cellulose delivery agents of the present invention. It has surprisingly been found that by using cationic celluloses as delivery enhancing agents, the delivery of the water insoluble fabric care benefit agent to the fabric is significantly enhanced, which would not otherwise be possible.

Although the cationic celluloses may provide fabric care benefits by themselves, an amount of the cationic celluloses needed to deliver significant performance benefits is much larger than an amount of the cationic celluloses needed as a delivery enhancing agent. However, large amounts of cationic celluloses often have a negative affect on cleaning performance. The cleaning negative caused by the large amount of cationic celluloses will normally prohibit their application in laundry detergent embodiments as the benefit agents alone. Importantly however, it the level of the cationic cellulose as the delivery enhancing agent, the impact on cleaning is normally very limited.

It has further been surprisingly discovered that the addition of the cationic celluloses of the present invention into laundry products may provide significant improvement in the delivery/deposition of the water insoluble fabric care benefit agent on the fabric versus utilizing the water insoluble fabric care benefit agent alone. In fact, it is surprising to find that when a laundry detergent containing cationic celluloses and the fabric care benefit agent are added in the washer, delivery/deposition enhancements of the water insoluble fabric care benefit agent on fabric of as much as 5 to 10 times the normal amount of benefit agent alone are observed.

It is also surprising to find that the delivery/deposition enhancements may be accomplished by mixing the cationic cellulose and the fabric care benefit agent together as a laundry additive of a fabric care composite or by formulating these two ingredients into laundry detergent or other laundry products.

The water insoluble benefit agents useful herein include dispersible polyolefins and polymer latexes. The water insoluble fabric care benefit agent preferably has a particle size of from about 1 nm to 100 um. The present invention also comprises a detergent or fabric softener composition wherein the composition comprises:

a. from about 1–80 wt % of an anionic, cationic, nonionic, amphoteric, zwitterionic surfactant or a combination thereof;

b. from about 0.1–10 wt % of a water insoluble benefit agent wherein said water insoluble fabric care benefit agent is polyolefin emulsion, latex, or a mixture thereof; and c. from about 0.01–2% of a cationic cellulose.

Preferably the ratio of the delivery enhancing agent to the fabric care benefit agent is from about 1:50 to about 1:1.

DETAILED DESCRIPTION OF THE INVENTION

The present invention relates to the use of cationic celluloses to enhance deposition of water insoluble fabric care benefit agents including dispersible polyolefins and latexes during laundering. Without being limited by theory, utilizing the cationic cellulose delivery enhancing agents of the present invention allows for improved delivery of the water insoluble fabric care benefit agent to the fabric so as to provide enhanced fabric softening, color protection, pill/fuzz reduction, anti-abrasion, anti-wrinkle, and other such benefits to garments and textiles.

The cationic cellulose, called the delivery enhancing agent, and the water insoluble fabric care benefit agent of the present invention may be mixed together prior to formulating in, adding to, or using in conjunction with a laundry product composition. The two components may be formulated into laundry products separated with different orders of addition. The two components of the present invention may also be mixed together in situ after addition to the laundry product composition. Additionally, the two components of the present invention may be applied directly to the fabric together or separately.

By using the delivery enhancing agent of the present invention, the deposition of the water insoluble fabric care benefit agent on the fabric is significantly improved and in some instances doubled, (i.e.; utilizing the delivery enhancing agent of the present invention may increase the deposition of the water insoluble fabric care benefit agent on the fabric by potentially about 100% or more compared with using the water insoluble fabric care benefit agent alone). Preferably deposition on the fabric will increase by at least about 200%. Since the fabric care benefit is directly related to the amount of deposition of the fabric care benefit agent on the fabric, the performance of the water insoluble fabric care benefit agent on the fabric should theoretically increase proportionately by potentially about 100% and preferably by at least about 200%.

The ratio of the delivery enhancing agent to the water insoluble fabric care benefit agent should be from about 1:50 to 1:1 and preferably from about 1:20 to 1:2. The two components of the present invention can be premixed to form a stable composite prior to formulating into a laundry product or prior to adding to the laundry process or applying to a fabric. The two components can also be formulated into laundry products separately with different orders of addition. The two components may also be mixed together so as to form the fabric care composite of the present invention in situ after formulating into the laundry product or adding to the laundry process.

All percentages, ratios and proportions herein are on a weight basis unless otherwise indicated. All documents cited herein are hereby incorporated by reference.

Delivery Enhancing Agents

As used herein, "delivery enhancing agent" refers to any cationic cellulose or combination of cationic celluloses that significantly enhance the deposition of the water insoluble fabric care benefit agent onto the fabric during laundering. The delivery enhancing agent of the present invention has a strong physical binding capability with the water insoluble fabric care benefit agent. It also has a very strong affinity to natural textile fibers, such as cotton fibers.

An effective delivery enhancing agent preferably has a strong binding capability with the water insoluble fabric care benefit agents via physical forces such as van der Waals forces or non-covalent chemical bonds such as hydrogen bonding and/or ionic bonding. It preferably has a very strong affinity to natural textile fibers, particularly cotton fibers.

The delivery enhancing agent should be water soluble and have a flexible molecular structure so that it can cover the water insoluble fabric care benefit agent particle surface or hold several particles together. Therefore, the delivery enhancing agent is preferably not cross-linked and preferably does not have a network structure as these both tend to lack molecular flexibility.

In order to drive the fabric care benefit agent onto the fabric, the net charge of the delivery enhancing agent is preferably positive in order to overcome the repulsion between the fabric care benefit agent and the fabric since most fabrics are comprised of textile fibers that have a slightly negative charge in aqueous environments. Examples of fibers exhibiting a slightly negative charge in water include but are not limited to cotton, rayon, silk, wool, etc.

Preferably, the delivery enhancing agent is a cationic or amphoteric polymer. The amphoteric polymers of the present invention will also have a net cationic charge, i.e.; the total cationic charges on these polymers will exceed the total anionic charge. The degree of substitution of the cationic charge can be in the range of from about 0.01 (one cationic charge per 100 polymer repeating units) to 1.00 (one cationic charge on every polymer repeating unit) and preferably from about 0.01 to 0.20. The positive charges could be on the backbone of the polymers or the side chains of polymers.

While there are many ways to calculate the charge density of cationic celluloses, the degree of substitution of the cationic charge can be simply calculated by the cationic charges per 100 glucose repeating units. One cationic charge per 100 glucose repeating units equals to 1% charge density of the cationic celluloses.

Preferred cationic celluloses for use herein include those which may or may not be hydrophobically-modified, having a molecular weight of from about 50,000 to about 2,000,000, more preferably from about 100,000 to about 1,000,000, and most preferably from about 200,000 to about 800,000. These cationic materials have repeating substituted anhydroglucose units that correspond to the general Structural Formula I as follows:

STRUCTURAL FORMULA I

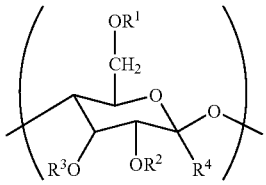

Wherein $R^1$, $R^2$, $R^3$ are each independently H, $CH_3$, $C_{8-24}$ alkyl (linear or branched),

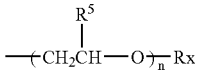

or mixtures thereof; wherein n is from about 1 to about 10; Rx is H, $CH_3$, $C_{8-24}$ alkyl (linear or branched),

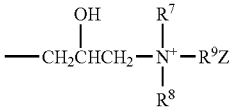

or mixtures thereof, wherein Z is a water soluble anion, preferably a chlorine ion and/or a bromine ion; $R^5$ is H, $CH_3$, $CH_2CH_3$ or mixtures thereof; $R^7$ is $CH_3$, $CH_2CH_3$, a phenyl group, a $C_{8-24}$ alkyl group (linear or branched), or mixture thereof; and $R^8$ and $R^9$ are each independently $CH_3$, $CH_2CH_3$, phenyl, or mixtures thereof: $R^4$ is H,

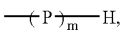

or mixtures thereof wherein P is a repeat unit of an addition polymer formed by radical polymerization of a cationic monomer such as

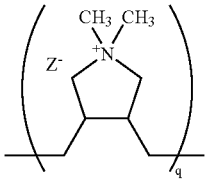

wherein Z' is a water-soluble anion, preferably chlorine ion, bromine ion or mixtures thereof and q is from about 1 to about 10.

Water-soluble anions useful herein include C8–C24 alkyl sulfates, C8–C24 alkyl alkoxy sulfates, preferably alkyl ethoxy sulfates, C8–C24 alkyl sulfonates, C8–C16 alkyl benzene sulfonates, xylene sulfonates, toluene sulfonates, cumene sulfonates, fatty alkyl carboxylates, chlorine ions, bromine ions, or mixtures thereof, while chlorine and/or bromine ions are preferred.

The charge density of the cationic celluloses herein (as defined by the number of cationic charges per 100 glucose units) is preferably from about 0.5% to about 60%, more preferably from about 1% to about 20%, and most preferably from about 2% to about 10%.

Alkyl substitution on the anhydroglucose rings of the polymer ranges from about 0.01% to 5% per glucose unit, more preferably from about 0.05% to 2% per glucose unit, of the polymeric material.

The cationic cellulose may lightly cross-linked with a dialdehyde such as glyoxyl to prevent forming lumps, nodules or other agglomerations when added to water at ambient temperatures.

The cationic cellulose ethers of Structural Formula I likewise include those which are commercially available and further include materials which can be prepared by conventional chemical modification of commercially available materials. Commercially available cellulose ethers of the Structural Formula I type include the JR 30M, JR 400, JR 125, LR 400 and LK 400 polymers, all of which are marketed by Dow Chemical.

Water Insoluble Fabric Care Benefit Agents

As used herein, "water insoluble fabric care benefit agent" refers to any dispersible polyolefins and polymer latexes which are water insoluble and can provide fabric care benefits such as fabric softening, color protection, pill/fuzz reduction, anti-abrasion, anti-wrinkle, and the like to garments and fabrics, particularly on cotton garments and fabrics, when an adequate amount of the material is present on the garment/fabric.

Non-limiting examples of water insoluble fabric care benefit agents include dispersible polyethylenes, polymer latexes and mixtures thereof. These can be in the form of emulsions, latexes, dispersions, suspensions, and the like. Preferably they are in the form of an emulsion or a latex. The water insoluble fabric care benefit agent can have a wide range of particle sizes from about 1 nm to 100 um and preferably from about 10 nm to 10 um.

Any surfactants suitable for making polymer emulsions or emulsion polymerizations of polymer latexes can be used to make the water insoluble fabric care benefit agents of the present invention. Suitable surfactants consist of emulsifiers for polymer emulsions and latexes, dispersing agents for polymer dispersions and suspension agents for polymer suspensions. Suitable surfactants include anionic, cationic, and nonionic surfactants or mixtures thereof. Nonionic and anionic surfactants are preferred. The ratio of surfactant to polymer in the water insoluble fabric care benefit agent is about 1:100 to about 1:2. Preferably, the ratio ranges from about 1:50 to 1:5. Suitable water insoluble fabric care benefit agents include but are not limited to the examples described below.

Dispersible Polyolefins

All dispersible polyolefins that provide fabric care benefits can be used as the water insoluble fabric care benefit agents according to the present invention. The polyolefins can be in the form of waxes, emulsions, dispersions or suspensions. Non-limiting examples are discussed below.

Preferably, the polyolefin is a polyethylene, polypropylene, or a mixture thereof. The polyolefin may be at least partially modified to contain various functional groups, such as carboxyl, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

For ease of formulation, the dispersible polyolefin is preferably introduced as a suspension or an emulsion of polyolefin dispersed by use of an emulsifying agent. The polyolefin suspension or emulsion preferably comprises from about 1% to about 60%, more preferably from about 10% to about 55%, and most preferably from about 20 to about 50% by weight of polyolefin. The polyolefin preferably has a wax dropping point (see ASTM D3954-94, volume 15.04—"Standard Test Method for Dropping Point of Waxes", the method incorporated herein by reference) from about 20 to 170° C. and more preferably from about 50 to 140° C. Suitable polyethylene waxes are available commercially from suppliers including but not limited to Honeywell (A–C polyethylene), Clariant (Velustrol emulsion), and BASF (LUWAX).

When an emulsion is employed, the emulsifier may be any suitable emulsification agent including anionic, cationic, or nonionic surfactants, or mixtures thereof Almost any suitable surfactant may be employed as the emulsifier of the present invention. The dispersible polyolefin is dispersed by use of an emulsifier or suspending agent in a ratio 1:100 to about 1:2. Preferably, the ratio ranges from about 1:50 to 1:5.

Polymer Latexes

Polymer latex is typically made by an emulsion polymerization process which includes one or more monomers, one or more emulsifiers, an initiator, and other components familiar to those of ordinary skill in the art. All polymer latexes that provide fabric care benefits can be used as water insoluble fabric care benefit agents of the present invention. Non-limiting examples of suitable polymer latexes include those disclosed in WO 02/018451 published in the name of Rhodia Chimie. Additional non-limiting examples include the monomers used in producing polymer latexes such as:

1) 100% or pure butylacrylate
2) Butylacrylate and butadiene mixtures with at least 20% (weight monomer ratio) of butylacrylate
3) Butylacrylate and less than 20% (weight monomer ratio) of other monomers excluding butadiene
4) Alkylacrylate with an alkyl carbon chain at or greater than C6
5) Alkylacrylate with an alkyl carbon chain at or greater than C6 and less than 50% (weight monomer ratio) of other monomers
6) A third monomer (less than 20% weight monomer ratio) added into monomer systems from 1) to 5)

Polymer latexes that are suitable fabric care benefit agents in the present invention include those having a glass transition temperature of from about −120° C. to about 120° C. and preferably from about −80° C. to about 60° C. Suitable emulsifiers include anionic, cationic, nonionic and amphoteric surfactants. Suitable initiators include all initiators that are suitable for emulsion polymerization of polymer latexes. The particle size of the polymer latexes can be from about 1 nm to about 10 μm and is preferably from about 10 nm to about 1 μm.

Laundry Products

A non-limiting list of optional components of the present invention includes laundry detergents, fabric conditioners, and other wash, rinse, and dryer added products. The laundry products may comprise from about 0.1% to about 20% of the water insoluble fabric care benefit agent, preferably from about 0.2% to about 10%. The laundry products may also comprise from about 0.01% to about 5% of the delivery enhancing agent, preferably from about 0.02% to about 2%. Conventional components of fabric conditioners include but are not limited to surfactants and the like. Conventional components of detergent compositions include but are not limited to surfactants, bleaches and bleach activators, enzymes and enzyme stabilizing agents, suds boosters or suds suppressers, anti-tarnish and anticorrosion agents, non-builder alkalinity sources, chelating agents, organic and inorganic fillers, solvents, hydrotropes, optical brighteners, dyes, perfumes, and modified cellulose ether fabric treatment agents. The fabric care benefit agents or delivery enhancing agent of the present invention may be a component of or added to a detergent composition or a fabric conditioner. The detergent composition may be in the form of a granule, liquid, or tablet. Detergent compositions of the present invention may be made in accordance with U.S. Pat. Nos. 6,274,540 and 6,306,817 and WIPO Publication Nos. WO 01/16237 published Mar. 8, 2001 and WO 01/16263 published on Mar. 8, 2001.

I. Surfactant

The laundry products of the present invention may comprise from about 1% to 80% by weight of a surfactant. Preferably such compositions comprise from about 5% to 50% by weight of surfactant. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$–$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Preferred nonionic surfactants are those of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides of the formula:

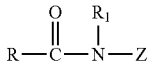

wherein R is a $C_{9-17}$ alkyl or alkenyl, $R_1$ is a methyl group and Z is glycidyl derived from a reduced sugar or alkoxylated derivative thereof. Examples are N-methyl N-1-deoxyglucityl cocoamide and N-methyl N-l-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

II. Builder

The compositions may also comprise from about 0.1% to 80% by weight of a builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al, U.S. Pat. No. 4,605,509, the disclosure of which is incorporated herein by reference. Also, crystalline layered silicates such as those discussed in Corkill et al, U.S. Pat. No. 4,605,509, incorporated herein by reference, are suitable for use in the detergent compositions of this invention.

III. Preferred Enzymes

The laundry products of the present invention may also comprise an enzyme that is a amylase, lipase, selected protease enzyme, or mixtures thereof. Enzymes are normally incorporated into detergent compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. Preferably, the laundry product compositions of the present invention may contain up to about 5 mg by weight, more typically from about 0.01 mg to about 3 mg, of active enzyme per gram of the detergent composition. Stated otherwise, the compositions herein will typically comprise from about 0.001% to about 5%, preferably from about 0.01% to about 1% by weight of the composition, of a commercial enzyme preparation. Protease enzymes are preferably present in such commercial preparations at levels sufficient to provide from 0.005 to 0.1 Anson units (AU) of activity per gram of composition. Higher active levels may be desirable in highly concentrated detergent formulations.

Selected proteases which are useful herein include the subtilisins which are obtained from particular strains of *B. subtilis* and *B. licheniformis.* A preferred protease is obtained from a strain of *Bacillus,* having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands. When desired, a protease having decreased adsorption and increased hydrolysis may be included in the compositions herein, as described in WO 9507791 to Procter & Gamble. Another recombinant trypsin-like protease for detergents suitable herein is described in WO 9425583 to Novo.

Any known amylase may be included in the compositions of the present invention.

Suitable lipase enzymes for use herein include those produced by microorganisms of the *Pseudomonas* group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* LIPOLASE® enzyme derived from *Humicola lanuginosa* and commercially available from Novo, see also EP 341,947, is a preferred lipase for use herein.

When the compositions of the present invention contain a compatible enzyme, the compositions preferably also contain an effective enzyme stabilizing system. The enzyme-containing compositions herein may therefore optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the enzymes useful herein. Such a system may be inherently provided by other formulation actives, or be added separately, e.g., by the formulator or by a manufacturer of enzymes. Such stabilizing systems can, for example, comprise calcium ion, boric acid, propylene glycol, short chain carboxylic acids, boronic acids, or mixtures thereof, and are designed to address different stabilization problems depending on the type and physical form of the detergent composition.

Liquid Laundry Detergents

Preferably, the laundry product compositions herein are formulated as liquid laundry detergents. The liquid laundry detergent compositions preferably comprise from about 3% to about 98%, preferably from about 15% to about 95%, by weight of the liquid detergent composition, of an aqueous liquid carrier which is preferably water. Preferably, the liquid laundry compositions according to the present invention should provide a wash solution pH from about 6 to about 10, more preferably from about 7 to about 9, in order to maintain a preferred stain removal performance by the liquid laundry products according to the present invention. If needed, the cleaning compositions may contain alkalinizing agents, pH control agents and/or buffering agents.

The density of the laundry detergent compositions herein preferably ranges from about 400 to about 1200 g/litre, more preferably from about 500 to about 1100 g/litre of composition measured at 20° C.

EXAMPLES

The following example laundry product formulations may be made by traditional methods and means as known to one of ordinary skill in the art.

Examples 1 and 2

Liquid Detergent

| Ingredient | Example 1 Wt % | Example 2 Wt % |
|---|---|---|
| C12–15 alkyl polyethoxylate sulfate | 12.31 | 12.31 |
| Linear alkylbenzene sulfonate | 5.39 | 5.39 |
| Ethanol | 3.44 | 3.44 |
| Monoethanolamine | 1.49 | 1.49 |
| Propandiol | 6.61 | 6.61 |
| C12–13 Alkyl polyethoxylate (9) | 2.18 | 2.18 |
| C12–14 alkyl dimethylamine N-oxide | 0.73 | 0.73 |
| C12–14 fatty acid | 1.98 | 1.98 |
| Citric acid | 3.96 | 3.96 |
| Borax | 1.50 | 1.50 |
| Sodium hydroxide (to pH 8.0) | 5.00 | 5.00 |
| Cationic Cellulose* | 0.10 | 0.20 |
| Polyethylene Wax emulsion** | 1.50 (based on wax content of emulsion) | 1.50 (based on wax content of emulsion) |
| Water, perfume, enzymes, suds suppressor, brightener, additional deposition aid & other optional ingredients | to 100% | to 100% |

*Supplied by Dow Chemicals.
**Using oxidized Polyethylene wax (ME68725 obtained from Michelman Incorporated of Cincinnati, Ohio) having an acid number of 14–17 KOH mg/g, a wax dropping point of 101° C., emulsified with a nonionic emulsifier, the emulsified polyethylene wax having a mean particle size diameter of 40 nm.

Examples 3 and 4

Powder Detergent

| Ingredient | Example 3 Wt % | Example 4 Wt % |
|---|---|---|
| C12 linear alkylbenzene sulfonate | 3.44 | 3.44 |
| C16–17 methyl branched alkyl sulfate | 9.41 | 9.41 |
| C14–15 alkyl sulfate | 4.04 | 4.04 |
| AlSil | 37.37 | 37.37 |
| $Na_2CO_3$ | 22.34 | 22.34 |
| PEG | 2.53 | 2.53 |

-continued

| Ingredient | Example 3 Wt % | Example 4 Wt % |
|---|---|---|
| DTPA | 0.72 | 0.72 |
| NaPAA | 1.03 | 1.03 |
| Perborate | 2.56 | 2.56 |
| Nonanoyloxybenzenesulfonate | 1.92 | 1.92 |
| Modified cellulose | 1.54 | 1.54 |
| Cationic Cellulose* | 0.15 | 0.20 |
| Polyethylene emulsion 2** | 1.50 (based on wax content of emulsion) | 2.50 (based on wax content of emulsion) |
| Water, perfume, enzymes, suds suppressor, brightener, additional deposition aid & other optional ingredients | to 100% | to 100% |

*Supplied by Dow Chemicals
**Using oxidized Polyethylene wax (ME68725 obtained from Michelman Incorporated of Cincinnati, Ohio) having an acid number of 14–17 KOH mg/g, a wax dropping point of 101° C., emulsified with a nonionic emulsifier, the emulsified polyethylene wax having a mean particle size diameter of 40 nm.

Examples 5 and 6

Fabric Conditioners

| Ingredient | Example 5 Wt % | Example 6 Wt % |
|---|---|---|
| Di-(tallowyl-oxy-ethyl) dimethyl ammonium chloride. | 18.0 | 24.0 |
| $NH_4Cl$ | 0.2 | 0.2 |
| Cationic Cellulose* | 0.2 | 0.3 |
| Polyethylene emulsion 2** | 3.0 | 2.0 |
| Water, perfume and minors | To 100% | To 100% |

*Supplied by Dow Chemicals
**Using oxidized Polyethylene wax (ME68725 obtained from Michelman Incorporated of Cincinnati, Ohio) having an acid number of 14–17 KOH mg/g, a wax dropping point of 101° C., emulsified with a nonionic emulsifier, the emulsified polyethylene wax having a mean particle size diameter of 40 nm.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry product composition comprising a stable mixture of:

a) from about 0.1% to about 10%, by weight of the composition of at least one water insoluble fabric care benefit agent wherein the water insoluble fabric care benefit agent is a dispersible polyolefin, polymer latex, or a mixture thereof and has a particle size of from about 1 nm to 100 um;

b) from about 0.0 1% to about 5% by weight of the composition, of at least one cationic cellulose delivery enhancing agent;

c) from about 1% to about 80% by weight of the composition, of a surfactant;

d) from about 3.96% to about 80% by weight of the composition, of a builder; and;

e) a compatible enzyme; wherein the ratio of the cationic cellulose delivery enhancing agent to the water insoluble fabric care benefit agent is from about 1:50 to about 1:1.

2. A laundry product composition according to claim 1 wherein the stable mixture is formed in situ.

3. A laundry product composition according to claim 1 wherein the cationic cellulose has the structure:

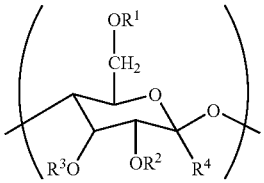

wherein $R^1$, $R^2$, $R^3$ are each independently H, $CH_3$, $C_{8-24}$ alkyl (linear or branched),

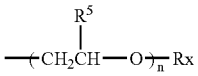

or mixtures thereof; wherein n is from about 1 to about 10; Rx is H, $CH_3$, $C_{8-24}$ alkyl (linear or branched),

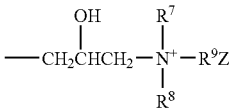

or mixtures thereof, wherein Z is a chlorine ion, bromine ion, or mixture thereof; $R^5$ is H, $CH_3$, $CH_2CH_3$, or mixtures thereof; $R^7$ is $CH_3$, $CH_2CH_3$, a phenyl group, a $C_{8-24}$ alkyl group (linear or branched), or mixture thereof; and $R^8$ and $R^9$ are each independently $CH_3$, $CH_2CH^3$, phenyl, or mixtures thereof:

$R^4$ is H,

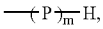

or mixtures thereof wherein P is a repeat unit of an addition polymer formed by radical polymerization of a cationic monomer

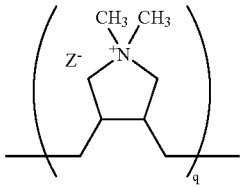

wherein Z' is a chlorine ion, bromine ion or mixtures thereof and q is from about 1 to about 10.

4. A detergent laundry product composition comprising:

a) from about 1% to about 80%, by weight of the composition, of a detersive surfactant that is an anionic surfactant, cationic surfactant, nonionic surfactant, amphoteric surfactant, zwitterionic surfactant, or a mixture thereof;

b) from about 0.1% to about 10%, by weight of the composition, of a water insoluble fabric care benefit agent wherein said water insoluble fabric care benefit agent is a dispersible polyolefin, polymer latex, or a mixture thereof;

c) from about 0.01% to about 5%, by weight of the composition, of a cationic cellulose delivery enhancing agent;

d) from about 3.96% to about 80%. by weight of the composition, of a builder; and; and e) a compatible enzyme; wherein the ratio of the delivery enhancing agent to the fabric care benefit agent is from about 1:50 to about 1:1.

5. A detergent composition according to claim 4 wherein the cationic cellulose has the structure:

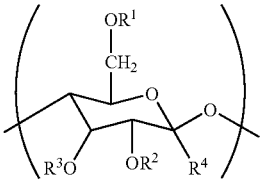

wherein $R^1$, $R^2$, $R^3$ are each independently H, $CH_3$, $C_{8-24}$ alkyl (linear or branched),

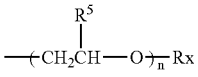

or mixtures thereof wherein n is from about 1 to about 10; Rx is H, $CH_3$, $C_{8-24}$ alkyl (linear or branched),

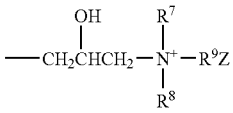

or mixtures thereof, wherein Z is a chlorine ion, bromine ion, or mixture thereof; $R^5$ *is H, CH*$_3$, $CH_2CH_3$ or mixtures thereof; $R^7$ is $CH_3$ $CH_2$, a phenyl group, a $C_{8-24}$ alkyl group (linear or branched), or mixture thereof; and R8 and $R^9$ are each independently $CH_3$, $CH_2CH_3$, phenyl, or mixtures thereof:

$R^4$ is H,

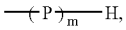

or mixtures thereof wherein P is a repeat unit of an addition polymer formed by radical polymerization of a cationic monomer

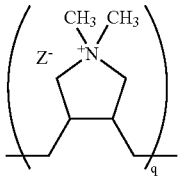

wherein Z' is a chlorine ion, bromine ion or mixtures thereof and q is from about 1 to about 10.

6. A detergent composition according to claim 4 wherein the fabric care benefit agent is a dispersible polyolefin that is a polyethylene, a polypropylene, or a mixture thereof.

7. A detergent composition according to claim 4 wherein the fabric care benefit agent is a polymer latex that is a pure butylacrylate, mixture of butylacrylate and a second monomer wherein the second monomer comprises less than 20%, by weight monomer ratio, or mixtures thereof.

8. A detergent composition according to claim 4 wherein the composition is a liquid detergent.

9. A laundry product composition according to claim 1 wherein the product is a fabric enhancer.

10. A laundry product composition according to claim 1 wherein the product is a dryer added product.

11. A laundry product composition according to claim 1 wherein the composition, further comprises from about 0.001% to about 10% of an effective enzyme stabilizing system.

12. A laundry product composition according to claim 1 wherein the enzyme stabilizing system comprises calcium ions, boric acid, propylene glycol, short chain carboxylic acids, boronic acids, or mixtures thereof.

13. A detergent composition according to claim 4 wherein the composition further comprises from about 0.001% to about 10% of an effective enzyme stabilizing system.

14. A detergent composition according to claim 13 wherein the enzyme stabilizing system comprises calcium ions, boric acid, propylene glycol, short chain carboxylic acids, boronic acids, or mixtures thereof.

15. A method of improving the fabric delivery efficacy of water insoluble fabric care benefit agents utilizing the detergent composition of claim 1.

16. A method of improving the fabric delivery efficacy of water insoluble fabric care benefit agents utilizing the detergent composition of claim 4.

* * * * *